US007274178B2

(12) United States Patent
Liu et al.

(10) Patent No.: US 7,274,178 B2
(45) Date of Patent: Sep. 25, 2007

(54) MULTI-LAMP DRIVER WITH ACTIVE CURRENT REGULATOR

(75) Inventors: Chun-Ting Liu, Hsinchu (TW); Chin-Der Wey, Miaoli (TW); Chia-Hung Sun, Koahsiung (TW)

(73) Assignee: AU Optronics Corporation (TW)

( * ) Notice: Subject to any disclaimer, the term of this patent is extended or adjusted under 35 U.S.C. 154(b) by 135 days.

(21) Appl. No.: 11/267,057

(22) Filed: Nov. 4, 2005

(65) Prior Publication Data

US 2007/0103127 A1 May 10, 2007

(51) Int. Cl.
*G05F 1/40* (2006.01)

(52) U.S. Cl. ..... 323/282; 323/288; 315/291; 315/282

(58) Field of Classification Search ..... 323/222, 323/266, 272, 274, 282, 283; 363/25–26, 363/97, 98, 55, 41; 315/307, 291, 225, 276
See application file for complete search history.

(56) References Cited

U.S. PATENT DOCUMENTS 3,270,184 A * 8/1966 Negromanti ..... 219/501
4,109,194 A * 8/1978 Miller ..... 323/283
5,204,587 A * 4/1993 Mortimer et al. ..... 315/308
5,930,121 A * 7/1999 Henry ..... 363/16
6,316,886 B1 * 11/2001 Luger et al. ..... 315/307

* cited by examiner

*Primary Examiner*—Rajnikant B. Patel
(74) *Attorney, Agent, or Firm*—Morris Manning & Martin LLP; Tim Tingkang Xia, Esq.

(57) ABSTRACT

An active current regulator circuit. In one embodiment, the active current regulator circuit includes a first input node for receiving a first reference electrical signal, a second input node for receiving a second reference electrical signal, a ground node, and an output node for outputting an output electrical signal with respect to the ground node. The active current regulator circuit further includes a PI controller having a first input node, a second input node, and an output node, and a linear regulator having a first input node electrically coupled to the output of the PI controller for receiving a voltage signal $V_0$ generated the PI controller, a first output node and a second output node. In operation the voltage signal $V_0$ is responsive to at least one input voltage signal applied to the first input of the second input of the amplifier, and drives the linear regulator to have a controlled electrical signal at its first output node accordingly.

26 Claims, 9 Drawing Sheets

MULTI-LAMP DRIVER WITH ACTIVE CURRENT REGULATOR

FIELD OF THE INVENTION

The present invention is generally related to a current regulator circuit, and, more particularly, is related to an active current regulator circuit and applications of same in a light structure for dynamically improving the brightness and uniformity of light emitted from the light structure.

BACKGROUND OF THE INVENTION

In a liquid crystal display (hereinafter "LCD") panel, a backlight having multiple lamps such as cold cathode fluorescent lamps (hereinafter "CCFL"s) is used to provide illumination. Usually, these lamps are individually driven by power conversion stages including drivers and transformers. FIG. 7 shows a conventional backlight driving structure, where driver 1, driver 2, . . . , driver N are attached to a printed circuit board (hereinafter "PCB") to drive lamps CCFL-1, CCFL-2, . . . , CCFL-N of the backlight, respectively, where N is an integer. For a large LCD panel, more lamps are needed in the backlight for providing sufficient illumination to the LCD panel. However, as the number of lamps is increased, the number of driving components of the backlight is increased accordingly, which adds up to a higher cost and a larger mechanical size. Furthermore, each of the power conversion stages operates at different frequencies. Such non-synchronous operation tends to result in a mutual interference, and more seriously, it may interfere the video signals of the LCD panel and result in ripple noises on the screen.

In order to reduce the cost of backlights, a balance circuit can be employed to allow a single driver to drive multiple lamps. FIG. 8 shows a conventional backlight driving structure using a balance circuit identified as "Cell." In the backlight driving structure, each of driver 1, driver 2, . . . , driver N is used to drive a pair of lamps and a balance circuit Cell is adapted for balancing lamp currents of the lamps CCFL-1, CCFL-2, . . . , CCFL-2N-1, CCFL-2N. Different types of balance circuit (Cell) 901, 902 and 903 are shown in FIG. 9. Typically, a balance circuit includes capacitors, inductors, and/or transformers. All these capacitors, inductors and transformers are passive components. Because of intrinsic limitations of the passive components, the more the passive components are used, the larger the errors in the balance circuit are. Additionally, the passive components are unable to self-adjust their parameters, thus the properties of the lamps are sensitive to their surrounding environment. When drivers operate at different frequencies from a predesigned frequency, operating parameters of the passive components need to be re-adjusted. The use of the passive components in the balance circuit thus may limit balancing effects of lamp currents in a backlight.

Alternatively, a current balance circuit using active components such as transistors, diodes and comparators is disclosed in U.S. Pat. No. 6,420,839 to Chiang et al., which is incorporated herein by reference in its entirety. As shown in FIG. 10, a current balance circuit 20 comprises a capacitor Cx seriesly connected to a slave lamp Lps, a first transistor Qp and a second transistor Qn with their collectors and emitters respectively coupled to the two ends of the capacitor Cx, a first diode Dp and a second diode Dn respectively coupled to the collector/emitter of the first transistor Qp and the second transistor Qn, and a comparator 22 having two inputs respectively connected to the sampling resistors Rm and Rs and one output connected to the bases of the first transistor Qp and the second transistor Qn. By using sampling resistors Rm and Rs, the current values Im and Is of the master lamp Lpm and the slave lamp Lps are converted into voltage values Vm and Vs, which are respectively fed to positive and negative inputs of the comparator 22. If Vm>Vs, i.e., the current Im passing through the master lamp Lpm is greater than the current Is passing through the slave lamp Lps, the comparator 22 outputs a high voltage (=Vref) and thereby drives the first transistor Qp and the second transistor Qn to discharge the capacitor Cx, so that the equivalent capacitive reactance of the capacitor Cx decreases, and thereby the current Is passing therethrough increases. If Vs>Vm, i.e., the current passing through the slave lamp Lps is greater than the current Im passing through the master lamp Lpm, the comparator 22 output a low voltage (=GND) and fails to drive the first transistor Qp and the second transistor Qn to discharge the capacitor Cx, so that the capacitive reactance of the capacitor Cx stays at the original value, the current Is passing therethrough decreases. The circuit balance circuit 20 is insensitive to the operating frequency and its surrounding environment. However, the transistors operate in its switching mode, thereby causing waveforms of the lamp currents nonsymmetrical. The nonsymmetrical current waveforms shorten the lifetime of the lamps. Additionally, two-bit outputs of a high and low voltage from the comparator result in inaccuracy in the lamp currents. Furthermore, the current balance circuit 20 as a long response time that may limit the performance of the backlight.

Therefore, a heretofore unaddressed need exists in the art to address the aforementioned deficiencies and inadequacies.

SUMMARY OF THE INVENTION

In one aspect, the present invention relates to an active current regulator circuit. In one embodiment, the active current regulator circuit includes a first input node for receiving a first reference electrical signal, a second input node for receiving a second reference electrical signal, a ground node, and an output node for outputting an output electrical signal with respect to the ground node.

The active current regulator circuit further includes a PI controller having a first input node, a second input node, and an output node. The PI controller comprises an amplifier having a first input connected to the first input node of the PI controller, a second input connected to the second input node of the PI controller, an output connected to the output node of the PI controller, and a first capacitor with a capacitance C1 electrically coupled between the second input and the output of the amplifier.

The active current regulator circuit also includes a linear regulator having a first input node, a second input node, a first output node and a second output node. The linear regulator comprises a first transistor with a base, an emitter and a collector, and a second transistor with a base, an emitter and a collector. The emitter of the first transistor is electrically connected to the collector of the second transistor, and the collector of the first transistor is electrically connected to the emitter of the second transistor, respectively. Additionally, the base of the first transistor is electrically coupled to the output of the PI controller through the first input node of the linear regulator, the base of the second transistor is electrically coupled to the output of the PI controller through the second input node of the linear regulator, the collector of the first transistor and the emitter of the second transistor are electrically connected to the first output node of the linear regulator, and the emitter of the first transistor and the collector of the second transistor are electrically connected to the second output node of the linear regulator, respectively. In one embodiment, the linear regulator further comprises a third resistor with a resistance R3 electrically connected to and between the first input node of the linear regulator and the base of the first transistor, and a fourth resistor with a resistance R4 electrically connected to and between the second input node of the linear regulator and the base of the second transistor.

Moreover, the active current regulator circuit includes a rectifier having a first input, a second input, and a first output, where the first input of the rectifier is electrically connected to the second output node of the linear regulator, the second input of the rectifier is electrically coupled to the ground node, and the first output of the rectifier is electrically coupled to the second input of the amplifier, respectively. In one embodiment, the rectifier comprises a first diode D1 with a positive terminal and a negative terminal, and a second diode D2 with a positive terminal and a negative terminal, where the positive terminal of the first diode D1 is electrically connected to the second input of the rectifier, the negative terminal of the first diode D1 and the positive terminal of the second diode D2 are electrically connected to each other and to the first input of the rectifier, and the negative terminal of the second diode D2 is electrically connected to the first output of the rectifier.

Furthermore, the active current regulator circuit includes an RC filter having an input and an output. The input of the RC filter is electrically connected to the first output of the rectifier, and the output of the RC filter is electrically coupled to the ground node. In one embodiment, the RC filter comprises a fifth resistor with a resistance R5 and a second capacitor with a capacitance C2, where the fifth resistor and the second capacitor are electrically coupled in series to and between the input and the output of the RC filter.

Additionally, the active current regulator circuit includes a dimmer having an input and an output, where the input of the dimmer is electrically connected to the second input node, and the output of the dimmer is electrically connectable to the first input node or the second input node of the PI controller. The dimmer comprises a diode D3 electrically coupled to the second input node through its one terminal in connection with the input of the dimmer, and a first resistor with a resistance R1 connected in series with the diode D3 and the output of the dimmer.

The active current regulator circuit may further comprises a resistor with a resistance R7 electrically connected to and between the first input node of the active current regulator circuit and the first input node of the PI controller.

In operation, a voltage signal $V_0$, which is generated at the output node of the PI controller responsive to at least one input voltage signal applied to the first input of the second input of the amplifier, drives the linear regulator to have a controlled electrical signal at the output node accordingly.

In one embodiment, the PI controller further comprises a second resistor with a resistance R2 connected in series with the second input of the amplifier and the first output of the rectifier. When the output of the dimmer is electrically connected to the second input node of the PI controller, the voltage signal $V_0$ at a given time t, $V_0(t)$, satisfies the following formula $$V_o(t) = V_{ref} + \frac{1}{R_2C_1}\int_0^{\tau}(V_{ref} - V_L)dt + \frac{1}{R_1C_1}\int_0^{\tau}(V_{ref} - V_d)dt,$$

where $V_{ref}$ is a first input voltage signal received at the first input node of the PI controller; $V_d$ is a second input voltage signal received at the second input node of the PI controller; $V_L$ is a third input voltage signal received at the second resistor from the first output of the rectifier; and $\tau$ is the period of the first input voltage signal $V_{ref}$; and wherein the PI controller functions as an I controller.

The PI controller may also comprise an optional resistor with a resistance R6 connected to the first capacitor in series and the output of the amplifier, and when the output of the dimmer is electrically connected to the second input node of the PI controller, the voltage signal $V_0$ at a given time t, $V_0(t)$, satisfies the following formula $$V_o(t) = V_{ref} + \frac{R_6}{R_2}(V_{ref} - V_L) + \frac{1}{R_2C_1}\int_0^{\tau}(V_{ref} - V_L)dt + \frac{R_6}{R_1}(V_{ref} - V_d) + \frac{1}{R_1C_1}\int_0^{\tau}(V_{ref} - V_d)dt$$

In one embodiment, the voltage signal $V_0(t)$ outputted by the PI controller has a waveform corresponding to the waveform of the second input voltage signal $V_d$, such that the controlled electrical signal at the output node can be varied accordingly by varying the waveform of the second input voltage signal $V_d$.

The present invention, in another aspect, relates to an active current regulator circuit. In one embodiment, the active current regulator circuit includes a first input node for receiving a first reference electrical signal, a second input node for receiving a second reference electrical signal, a ground node, and an output node for outputting an output electrical signal with respect to the ground node.

The active current regulator circuit further includes a PI controller having a first input node, a second input node, and an output node, wherein the PI controller comprises an amplifier having a first input connected to the first input node of the PI controller, a second input connected to the second input node of the PI controller, an output connected to the output node of the PI controller, and a first capacitor with a capacitance C1 electrically coupled between the second input and the output of the amplifier. The PI controller may further comprise a second resistor with a resistance R2 connected in series with the second input of the amplifier and the first output of the rectifier, and an optional resistor with a resistance R6 connected to the first capacitor in series and the output of the amplifier.

Moreover, the active current regulator circuit includes a linear regulator, having a first input node, electrically coupled to the output of the PI controller, a first output node, and a second output node, and for receiving a voltage signal $V_0$ from the output of the PI controller through the first input node, of the linear regulator, where in operation the voltage signal $V_0$ generated by the PI controller responsive to at least one input voltage signal applied to the first input of the second input of the amplifier drives the linear regulator, to have a controlled electrical signal at the output node accordingly.

In one embodiment, the linear regulator comprises a first transistor with a base, an emitter and a collector, and a second transistor with a base, an emitter and a collector, wherein the emitter of the first transistor is electrically connected to the collector of the second transistor, and the collector of the first transistor is electrically connected to the emitter of the second transistor, respectively, and wherein the base of the first transistor is electrically coupled to the output of the PI controller through the first input node of the linear regulator, the base of the second transistor is electrically coupled to the output of the PI controller through the second input node of the linear regulator, the collector of the first transistor and the emitter of the second transistor are electrically connected to the first output node of the linear regulator, and the emitter of the first transistor and the collector of the second transistor are electrically connected to the second output node of the linear regulator, respectively.

In another embodiment, the linear regulator comprise a transistor with a base, an emitter and a collector, and an impedance electrically connected to and between the collector and the emitter of the transistor, and wherein the base of the transistor is electrically coupled to the output of the PI controller through the first input node of the linear regulator, the collector of the transistor is electrically connected to the first output node of the linear regulator, and the emitter of the transistor is electrically connected to the second output node of the linear regulator, respectively. The impedance comprises one of a resistor, a capacitor and an inductor.

The active current regulator circuit may further comprise a dimmer having an input and an output, where the input of the dimmer is electrically connected to the second input node, and the output of the dimmer is electrically connectable to the first input node or the second input node of the PI controller. In one embodiment, the dimmer further comprises a diode D3 electrically coupled to the second input node through its one terminal in connection with the input of the dimmer, and a first resistor with a resistance R1 connected in series with the diode D3 and the output of the dimmer.

In one embodiment, the active current regulator circuit may comprise a rectifier having a first input, a second input, and a first output, wherein the first input of the rectifier is electrically connected to the second output node of the linear regulator, the second input of the rectifier is electrically coupled to the ground node, and the first output of the rectifier is electrically coupled to the second input of the amplifier, respectively.

The active current regulator circuit may also comprise an RC filter having an input and an output, wherein the input of the RC filter is electrically connected to the first output of the rectifier, and the output of the RC filter is electrically coupled to the ground node. In one embodiment, the RC filter further comprises a fifth resistor with a resistance R5 and a second capacitor with a capacitance C2, and wherein the fifth resistor and the second capacitor are electrically coupled in series to and between the input and the output of the RC filter.

In yet another aspect, the present invention relates to a light structure. In one embodiment, the light structure comprises a single driver electrically connectable to a DC power supply for converting a DC voltage to an AC voltage. The light structure also includes a transformer comprising a primary coil having a first end and a second end and a secondary coil having a first end and a second end. The first end and the second end of the primary coil are electrically coupled to the single driver for receiving the AC voltage, and the second end of the secondary coil is electrically coupled to ground, and wherein the primary coil and secondary coil are electromagnetically coupled to each other and so arranged that when the AC voltage from the single driver 304 is applied to the first end and the second end of the primary coil, an output voltage is generated between the first end and the second end of the secondary coil.

The light structure further includes an lamp module having N lamps, $L_1, L_2, \ldots, L_N$, N being an integer, wherein lamp $L_i$ has a first terminal $T_{i1}$ and a second terminal $T_{i2}$, i=1, . . . , N, and the N lamps are electrically coupled to the secondary coil in parallel and arranged such that each first terminal $T_{i1}$, of lamp $L_i$ is electrically connected to the first end of the secondary coil for receiving the output voltage from the secondary coil and a corresponding current $I_{Li}$ is generated at the corresponding second terminal $T_{i2}$ of lamp $L_i$.

Moreover, the light structure includes a current regulator module electronically coupled to the N lamps through the second terminals $\{T_{i2}\}$ of lamp $\{L_i\}$, i=1, . . . , N, for dynamically regulating the currents $\{I_{Li}\}$, respectively. The current regulator module comprises at least one active current regulator circuit for dynamically regulating at least one of the lamp $\{L_i\}$, i=1, . . . , N in response to a voltage reference signal received by the current regulator module. In one embodiment, the current regulator module comprise N−1 active current regulator circuit, $\{ACR_i\}$, i=2, . . . , N, and each active current regulator circuit $ACR_i$ electrically connected to the second terminal $T_{i2}$ of a corresponding lamp $L_i$ for dynamically regulating current $I_{Li}$ of the corresponding lamp $L_i$ in response to a voltage reference signal received by the active current regulator circuit $ACR_i$. The active current regulator circuit $ACR_i$ has a first input node $A_i$ for receiving a first voltage reference $V_{ref}$, a second input node $B_i$ for receiving a second voltage reference $V_{di}$, a ground node $C_i$ for grounding the active current regulator circuit $ACR_i$, and an output node $D_i$ for allowing the current $I_{Li}$ to pass through, and wherein in operation, a control voltage signal, which is generated at the output node $D_i$ responsive to at least one voltage reference applied to the first input node $A_i$ ($V_{ref}$) and second input node $B_i$ ($V_{di}$), regulates the current $I_{Li}$ accordingly, where the first voltage reference $V_{ref}$ is corresponding to the $I_{L1}$.

Additionally, the light structure includes a digital controller in communication with the current regulator and for receiving a voltage reference signal and providing a corresponding control voltage to the current regulator module to drive the current regulator module to regulate at least one of the currents $\{I_{Li}\}$ of lamp $\{L_i\}$, i=1, . . . , N.

The light structure may further comprise a controller chip in communication with the single driver for providing a controlling signal to the single driver. In one embodiment, the light structure may comprise N capacitors, $\{C_{Li}\}$, i=1, . . . , N, and each capacitor $C_{Li}$ electrically connected to the first terminal $T_{i1}$ of a corresponding lamp $L_i$ in series.

In a further aspect, the present invention relates to a light structure. In one embodiment, the light structure comprises a single driver electrically connectable to a DC power supply for converting a DC voltage to an AC voltage. Furthermore, the light structure comprises a transformer that includes a primary coil having a first end and a second end and a secondary coil having a first end and a second end, wherein the first end and the second end of the primary coil are electrically coupled to the single driver for receiving the AC voltage, and the second end of the secondary coil is electrically coupled to ground, and wherein the primary coil and secondary coil are electromagnetically coupled to each other and so arranged that when the AC voltage from the single driver is applied to the first end and the second end of the primary coil, an output voltage is generated between the first end and the second end of the secondary coil.

The light structure may comprise an impedance member electrically coupled to the secondary coil in parallel with the N−1 lamps to allow a current $I_{L1}$ to pass through, wherein the impedance member has an effective impedance $Z_{Lf}$, where the impedance member comprises one of a resistor, a capacitor and an inductor.

Additionally, the light structure comprises an lamp module having N−1 lamps, $L_2, \ldots, L_N$, N being an integer, wherein lamp $L_i$ has a first terminal $T_{i1}$ and a second terminal $T_{i2}$, i=2, . . . , N, and the N−1 lamps are electrically coupled to the secondary coil in parallel and arranged such that each first terminal $T_{i1}$ of lamp $L_i$ is electrically connected to the first end of the secondary coil for receiving the output voltage from the secondary coil and a corresponding current $I_{Li}$ is generated at the corresponding second terminal $T_{i2}$ of lamp $L_i$.

The light structure also comprises a current regulator module electronically coupled to the N−1 lamps through the second terminals $\{T_{i2}\}$ of lamp $\{L_i\}$, i=2, . . . , N, for dynamically regulating the currents $\{I_{Li}\}$, respectively. In one embodiment, the current regulator module comprises N−1 active current regulator circuit, $\{ACR_i\}$, i=2, . . . , N, and each active current regulator circuit $ACR_i$ is electrically connected to the second terminal $T_{i2}$ of a corresponding lamp $L_i$ for dynamically regulating current $I_{Li}$ of the corresponding lamp $L_i$ in response to a voltage reference signal received by the active current regulator circuit $ACR_i$.

The light structure may further comprises a digital controller in communication with the current regulator and for receiving a voltage reference signal and providing a corresponding control voltage to the current regulator module to drive the current regulator module to regulate at least one of the currents $\{I_{Li}\}$ of lamp $\{L_i\}$, i=2, . . . , N, and a controller chip in communication with the single driver for providing a controlling signal to the single driver.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
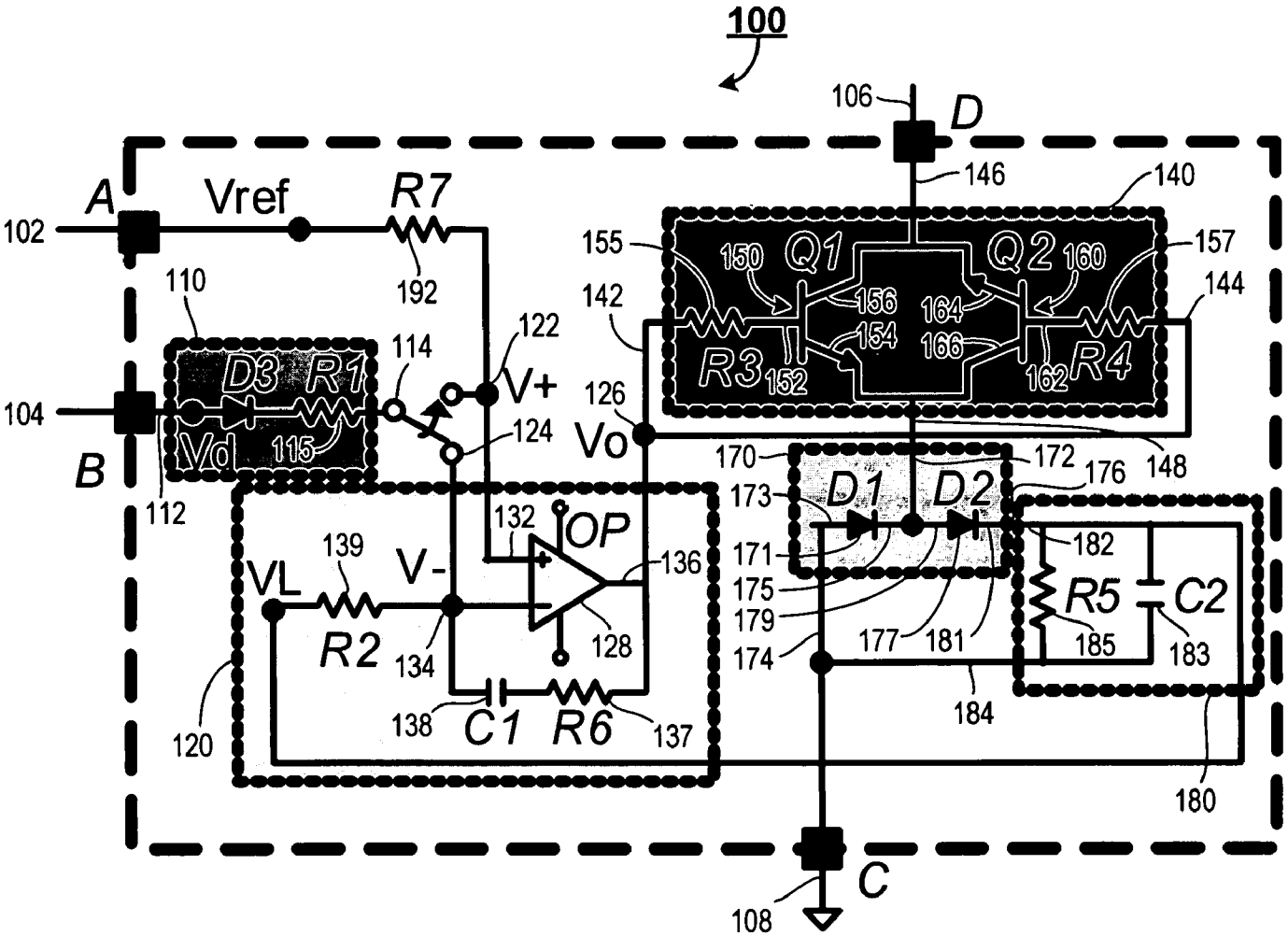
FIG. 1 shows a diagram of an active current regulator circuit according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The description will be made as to the embodiments of the present invention in conjunction with the accompanying drawings of FIGS. 1-6. In accordance with the purposes of this invention, as embodied and broadly described herein, this invention, in one aspect, relates to an active current regulator circuit and applications of the same in a light structure for dynamically improving the brightness and uniformity of light emitted from the light structure.

Referring now to FIG. 1, an active current regulator circuit 100 is shown according to one embodiment of the present invention. In the embodiment, the active current regulator circuit 100 has a first input node 102 for receiving a first reference electrical signal with a voltage $V_{ref}$, a second input node 104 for receiving a second reference electrical signal with a voltage $V_d$, a ground node 108, and an output node 106 for outputting an output electrical signal with respect to the ground node 108. The active current regulator circuit 100 comprises a dimmer 110, a proportional integrator (PI) controller 120, a linear regulator 140, a rectifier 170, and an RC filter 180.

As shown in FIG. 1, the PI controller 120 has a first input node ($V_+$) 122, a second input node ($V_-$) 124, and an output node 126. The dimmer 110 has an input 112 and an output 114, where the input 112 of the dimmer 110 is electrically connected to the second input node 104, and the output 114 of the dimmer 110 is electrically connectable to the first input node ($V_+$) 122 or the second input node ($V_-$) 124 of the PI controller 120.

The dimmer 110 comprises a diode D3 electrically coupled to the second input node 104 of the active current regulator circuit 100 through its one terminal in connection with the input 112 of the dimmer 110, and a resistor 115 with a resistance R1 connected in series with the diode D3 and the output 114 of the dimmer 110. The dimmer 110 is adapted for providing the second reference electrical signal ($V_d$) from its output 114 to the first input node ($V_+$) 122 or the second input node ($V_-$) 124 of the PI controller 120.

The PI controller 120 includes an amplifier 128 and a capacitor 138 with a capacitance C1 electrically coupled between the second input 134 and the output 136 of the amplifier 128. The amplifier 128 has a first input 132 connected to the first input node ($V_+$) 122 of the PI controller 120, a second input 134 connected to the second input node ($V_-$) 124 of the PI controller 120, and an output 136 connected to the output node 126 of the PI controller 120. As shown in FIG. 1, the PI controller 120 further comprises a resistor 139 with a resistance R2 connected in series with the second input 134 of the amplifier 128 and the first output 176 of the rectifier 170, and a resistor 137 with a resistance R6 connected to the capacitor 138 in series and the output 136 of the amplifier 128.

When the output 114 of the dimmer 110 is electrically connected to the second input node ($V_-$) 124 of the PI controller 120, the voltage signal $V_0$ at a given time t, $V_0(t)$, outputted by the PI controller 120, satisfies the following formula $$V_o(t) = V_{ref} + \frac{R_6}{R_2}(V_{ref} - V_L) + \frac{1}{R_2C_1}\int_0^{\tau}(V_{ref} - V_L)dt + \frac{R_6}{R_1}(V_{ref} - V_d) + \frac{1}{R_1C_1}\int_0^{\tau}(V_{ref} - V_d)dt, \quad (1)$$

where $V_{ref}$ is a first input voltage signal (a first reference electrical signal) received at the first input node 122 of the PI controller 120; $V_d$ is a second input voltage signal (a second reference electrical signal) received at the second input node 124 of the PI controller 120; $V_L$ is a third input voltage signal received at the resistor 139 from the first output 176 of the rectifier 170; and $\tau$ is the period of the first input voltage signal $V_{ref}$. The first input voltage signal $V_{ref}$ is associated with a current signal of a lamp tube, or an effective lamp impedance. The second input voltage signal $V_d$ is associated with a current signal of a lamp tube to be controlled. The voltage signal $V_0(t)$ has a waveform corresponding to the waveform of the second input voltage signal $V_d$, such that the controlled electrical signal at the output node 106 can be varied accordingly by varying the waveform of the second input voltage signal $V_d$.

When the resistance R6 of the resistor 137 is zero, i.e., R6=0, the output voltage signal $V_0$ of the PI controller 120 at a given time t is obtained to be $$V_o(t) = V_{ref} + \frac{1}{R_2C_1}\int_0^{\tau}(V_{ref} - V_L)dt + \frac{1}{R_1C_1}\int_0^{\tau}(V_{ref} - V_d)dt, \quad (2)$$

In this case, the PI controller 120 functions as an integrator controller.

It can be seen from the formulae (1) and (2) that changes in any one of the voltage signals $V_L$, $V_d$ and $V_{ref}$ result in changes of the output voltage signal $V_0(t)$ from the PI controller 120. Thus, when the input voltage $V_d$ of the dimmer 110 changes, the output voltage signal $V_0(t)$ from the PI controller 120 changes accordingly, so as to regulate the waveform and value of the lamp current of the lamp to be controlled. Additionally, it can be concluded from the formulae (1) and (2) that, to output a stable voltage signal $V_0$ from the PI controller 120 to drive the linear regulator 140, the signal $V_L$ must be equal to the first input voltage signal $V_{ref}$.

In the exemplary embodiment shown in FIG. 1, the linear regulator 140 has a first input node 142, a second input node 144, a first output node 146 and a second output node 148. The linear regulator 140 comprises a first transistor (Q1) 150 with a base 152, an emitter 154 and a collector 156, and a second transistor (Q2) 160 with a base 162, an emitter 164 and a collector 166. The emitter 154 of the first transistor (Q1) 150 is electrically connected to the collector 166 of the second transistor (Q2) 160, and the collector 156 of the first transistor (Q1) 150 is electrically connected to the emitter 164 of the second transistor (Q2) 160, respectively. Furthermore, the base 152 of the first transistor (Q1) 150 is electrically coupled to the output 126 of the PI controller 120 through the first input node 142 of the linear regulator 140, the base 162 of the second transistor (Q2) 160 is electrically coupled to the output 126 of the PI controller 120 through the second input node 144 of the linear regulator 140, respectively. Additionally, the collector 156 of the first transistor (Q1) 150 and the emitter 164 of the second transistor (Q2) 160 are electrically connected to the first output node 146 of the linear regulator 140, and the emitter 154 of the first transistor (Q1) 150 and the collector 166 of the second transistor (Q2) 160 are electrically connected to the second output node 148 of the linear regulator 140, respectively. The linear regulator 140 also comprises a resistor 155 with a resistance R3 electrically connected to and between the first input node 142 of the linear regulator 140 and the base 152 of the first transistor (Q1) 150, and a resistor 157 with a resistance R4 electrically connected to and between the second input node 144 of the linear regulator 140 and the base 162 of the second transistor (Q2) 160.

The rectifier 170 has a first input 172, a second input 174, and a first output 176, where the first input 172 of the rectifier 170 is electrically connected to the second output node 148 of the linear regulator 140, the second input 174 of the rectifier 170 is electrically coupled to the ground node 108, and the first output 176 of the rectifier 170 is electrically coupled to the second input 134 of the amplifier 128, respectively. In this embodiment shown in FIG. 1, the rectifier 170 comprises a first diode D1 (171) with a positive terminal 173 and a negative terminal 175, and a second diode D2 (177 ) with a positive terminal 179 and a negative terminal 181. The positive terminal 173 of the first diode D1 (171) is electrically connected to the second input 174 of the rectifier 170, the negative terminal 175 of the first diode D1 (171) and the positive terminal 179 of the second diode D2 (177) are electrically connected to each other and to the first input 172 of the rectifier 170, and the negative terminal 181 of the second diode D2 (177) is electrically connected to the first output 176 of the rectifier 170.

As shown in FIG. 1, the RC filter 180 has an input 182 and an output 184, wherein the input 182 of the RC filter 180 is electrically connected to the first output 176 of the rectifier 170, and the output 184 of the RC filter 180 is electrically coupled to the ground node 108. The RC filter 180 comprises a resistor 185 with a resistance R5 and a capacitor 183 with a capacitance C2, where the resistor 185 and the capacitor 183 are electrically coupled in parallel to and between the input 182 and the output 184 of the RC filter 180.

The active current regulator circuit 100 may further comprise a resistor 192 with a resistance R7 electrically connected to and between the first input node 102 of the active current regulator circuit and the first input node 122 of the PI controller 120.

In operation, the voltage signal $V_0$ generated at the output node 126 of the PI controller 120 responsive to at least one input voltage signal applied to the first input 132 of the amplifier 128 drives the linear regulator 140 to output a controlled electrical signal at the output node 106 accordingly. More specifically, a voltage signal is applied to the first input node 102 of the active current regulator circuit 100 as a first voltage reference signal $V_{ref}$. The first voltage reference signal $V_{ref}$ is introduced into the first input node ($V_+$) 122 of a PI controller 120 of the active current regulator circuit 100. Meanwhile, a current signal is introduced into the node 106 of the active current regulator circuit 100. The current signal passes through the linear regulator 140, the rectifier 170 and then the RC filter 180 of the active current regulator circuit 100 and is converted into a second voltage reference signal VL. The second voltage reference signal VL is then applied to a second input node (V_) 124 of the PI controller 120 of the active current regulator circuit 100. Accordingly, the PI controller 120 generates and outputs a corresponding voltage signal $V_0$ to drive the linear regulator 140. In the embodiment shown in FIG. 1, the linear regulator 140 functions as an effective resistor with a variable resistance that is dependent from the voltage signal $V_0$. Therefore, the current passing through the linear regulator 140 regulator 140 varies with the voltage signal $V_0$.

Figure 2:
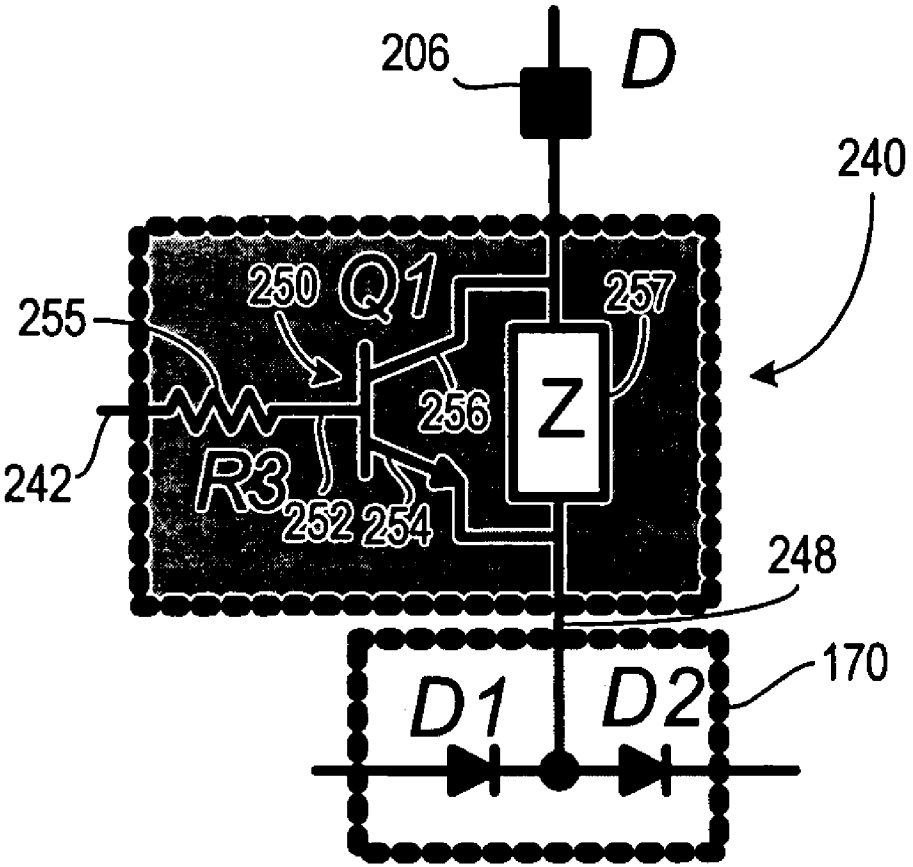
FIG. 2 shows a diagram of a linear regulator according to one embodiment of the present invention.

Referring to FIG. 2, a linear regulator 240 is shown according to one embodiment of the present invention. The linear regulator 240 in this embodiment includes a transistor (Q1) 250 with a base 252, an emitter 254 and a collector 256, and an impedance 257 electrically connected to and between the collector 256 and the emitter 254 of the transistor (Q1) 250. The base 252 of the transistor (Q1) 250 is electrically coupled to an output of a PI controller through the first input node 242 of the linear regulator 240, the collector 256 of the transistor (Q1) 250 is electrically connected to the first output node 246 of the linear regulator 240, and the emitter 254 of the transistor (Q1) 250 is electrically connected to the second output node 248 of the linear regulator 240, respectively. The linear regulator 240 may also include a resistor 255 with a resistance R3 electrically connected to and between the first input node 242 of the linear regulator 240 and the base 252 of the transistor (Q1) 250, as shown in FIG. 2. The impedance 257 comprises at least one of a resistor, a capacitor and an inductor.

Figure 3:
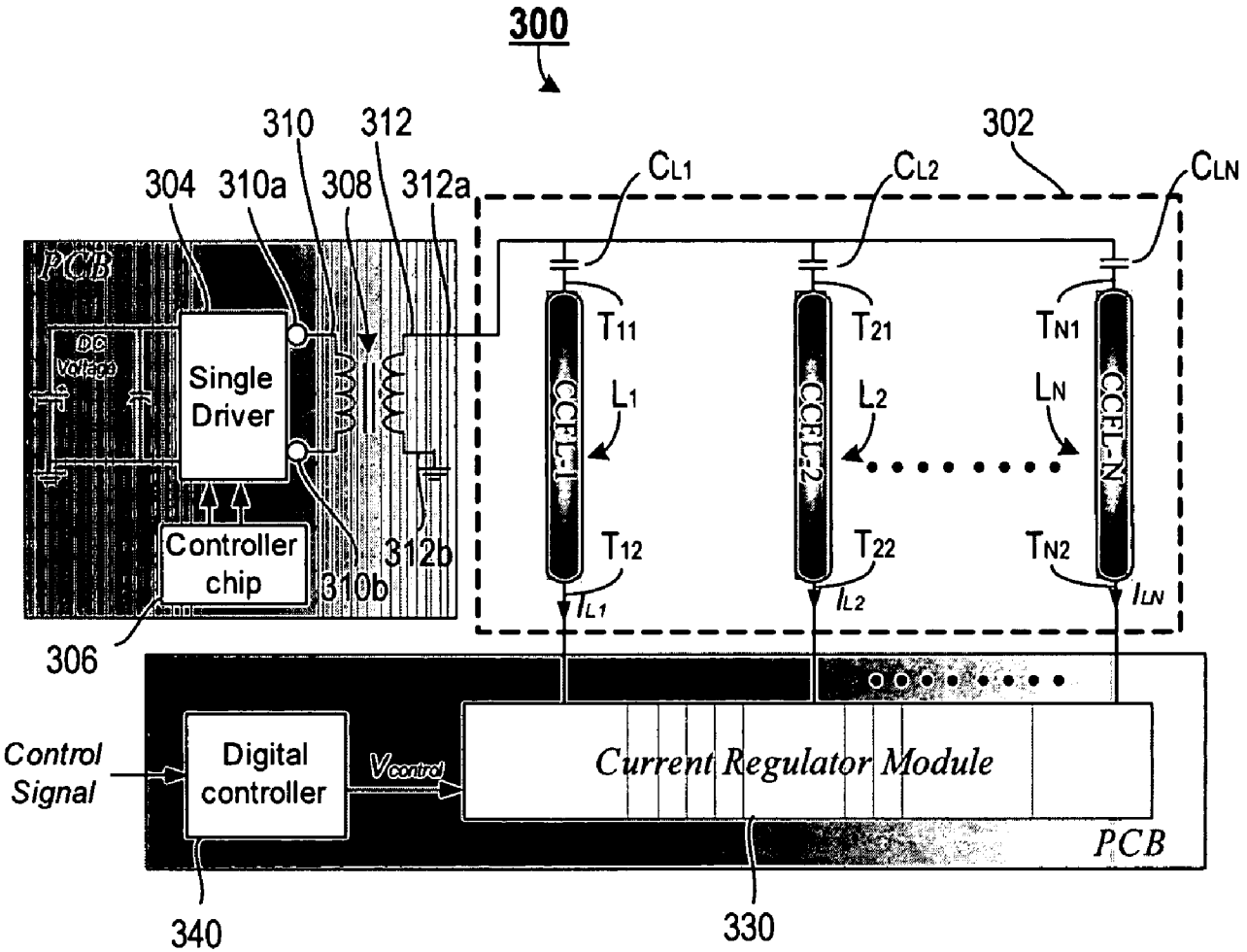
FIG. 3 shows a diagram of a light structure according to one embodiment of the present invention.

Referring to FIG. 3, a light structure 300 is shown according to one embodiment of the present invention. In this embodiment, the light structure 300 comprises a single driver 304, a controller chip 306 in communication with the single driver 304 for providing a controlling signal to the single driver 304, a transformer 308 coupled with the single driver 304, an lamp module 302 coupled with the transformer 308, and a current regulator module 330 coupled with the lamp module 302 for regulating the lamp tube currents of the lamp module 302.

The single driver 304 is electrically connected to a DC power supply for converting a DC voltage to an AC voltage. The transformer 308 includes a primary coil 310 having a first end 310*a* and a second end 310*b*, and a secondary coil 312 having a first end 312*a* and a second end 312*b*. The first end 310*a* and the second end 310*b* of the primary coil 310 are electrically coupled to the single driver 304 for receiving the AC voltage, and the second end 312*b* of the secondary coil 312 is electrically coupled to ground. The primary coil 310 and secondary coil 312 are electromagnetically coupled to each other and arranged such that when the AC voltage from the single driver 304 is applied to the first end 310*a* and the second end 310*b* of the primary coil 310, an output voltage is generated between the first end 312*a* and the second end 312*b* of the secondary coil 312. The generated output voltage is then applied to the lamp module 302 to drive the lamp module 302.

The lamp module 302 in this embodiment has N lamps, $L_1, L_2, \ldots, L_N$, where N is an integer. Lamp $L_i$ has a first terminal $T_{i1}$ and a second terminal $T_{i2}$, and the N lamps are electrically coupled to the secondary coil 312 in parallel and arranged such that each first terminal $T_{i1}$ of lamp $L_i$ is electrically connected to the first end 312*a* of the secondary coil 312 for receiving the output voltage from the secondary coil 312 and a corresponding lamp current $I_{Li}$ is generated at the corresponding second terminal $T_{i2}$ of lamp $L_i$. The lamp module 302 also has N capacitors, $\{C_{Li}\}$, and each capacitor $C_{Li}$ is electrically connected to the first terminal $T_{i1}$ of a corresponding lamp $L_i$ in series, where i=1, . . . , N.

The current regulator module 330 is electronically coupled to the N lamps through the second terminals $\{T_{i2}\}$ of lamp $\{L_i\}$, for dynamically regulating the lamp currents $\{I_{Li}\}$, respectively. The current regulator module 330 may includes integrated current regulator circuits such as IC chips and/or individual current regulator circuits. When the lamp currents $\{I_{Li}\}$ of the lamps $\{L_i\}$ are received, the current regulator module 330 regulates each lamp current to its corresponding value in response to a voltage reference signal received by the current regulator module 330. The voltage reference signal is associated with one of the lamp currents $\{I_{Li}\}$, or a current of an effective lamp impedance. The regulation of the lamp currents $\{I_{Li}\}$ can be implemented by one or more active current regulator circuits (not shown). Additionally, a digital controller 340 is in communication with the current regulator 330 and for receiving a control signal and providing a corresponding control voltage $V_{control}$ to the current regulator module 330 to drive the current regulator module 330, thereby synchronizing the lamps $\{L_i\}$ and adjusting the brightness of the lamps $\{L_i\}$ in real time, where i=1, . . . , N.

Figure 4:
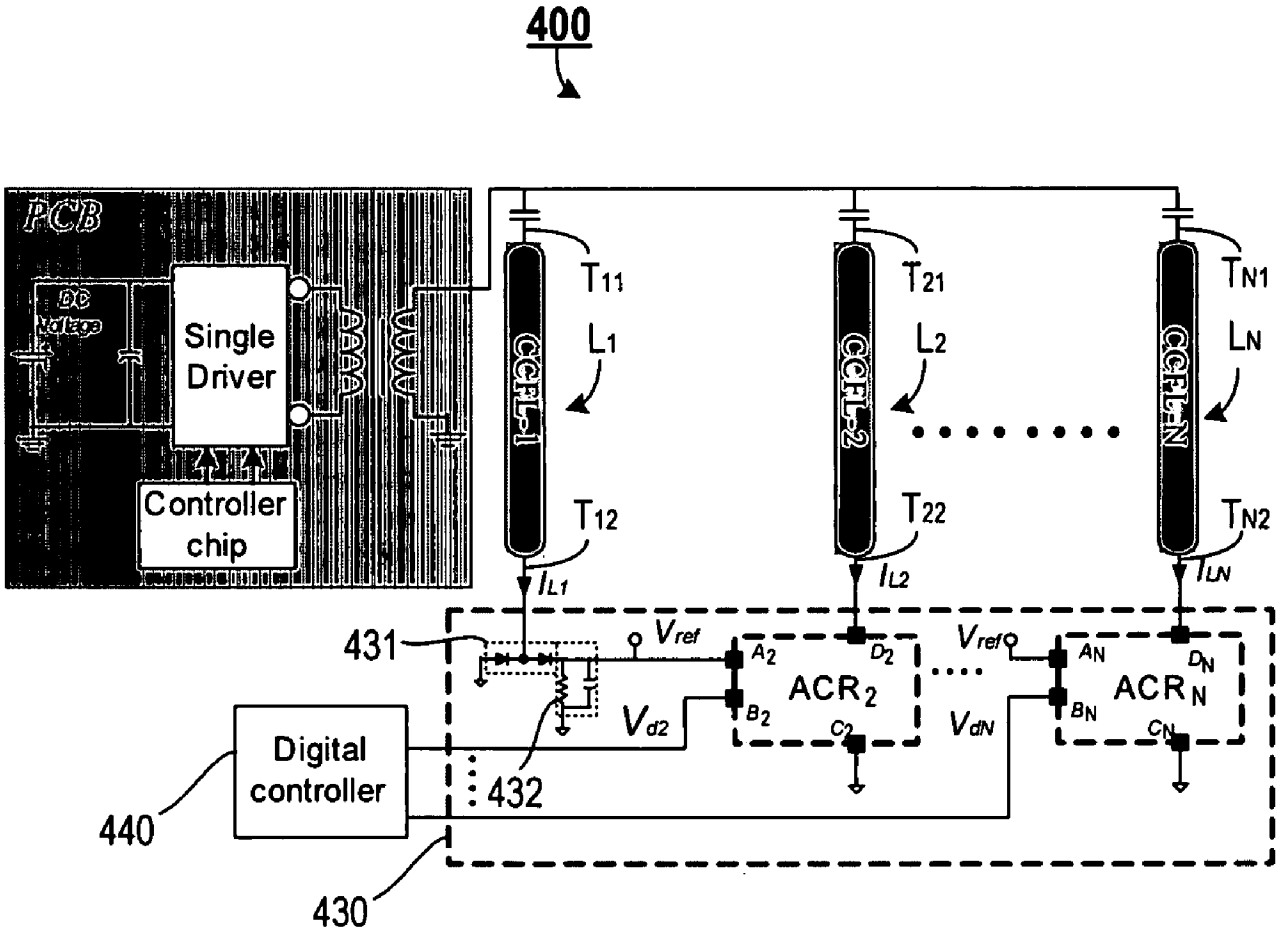
FIG. 4 shows a diagram of a light structure according to another embodiment of the present invention.

FIG. 4 shows an example of a light structure 400 according to one embodiment of the present invention, where the current regulator module 430 comprise N−1 active current regulator circuit, $\{ACR_i\}$, i=2, . . . , N, and each active current regulator circuit $ACR_i$ is electrically connected to the second terminal $T_{i2}$ of a corresponding lamp $L_i$ for dynamically regulating current $I_{Li}$ of the corresponding lamp $L_i$ in response to a voltage reference signal received by the active current regulator circuit $ACR_i$. The active current regulator circuit $ACR_i$ has a first input node $A_i$ for receiving a first voltage reference $V_{ref}$ a second input node $B_i$ for receiving a second voltage reference $V_{di}$, a ground node $C_i$ for grounding the active current regulator circuit $ACR_i$, and an output node $D_i$ for allowing the current $I_{Li}$ to pass through. In operation, a control voltage signal, which is generated at the output node $D_i$ of the active current regulator circuit $ACR_i$ in response to at least one voltage reference applied to the first input node $A_i$ ($V_{ref}$) and second input node $B_i$ ($V_{di}$), regulates the current $I_{Li}$ accordingly, where the first voltage reference $V_{ref}$ is corresponding to the lamp current $I_{L1}$ of the first lamp $L_1$. Specifically, the lamp current $I_{L1}$ of the first lamp $L_1$ is introduced into a rectifier 431 and then to a RC filter 432 for converting the lamp current $I_{L1}$ into a voltage reference signal $V_{ref}$. The voltage reference signal $V_{ref}$ is then applied to the first input node $A_i$ of the active current regulator circuit $ACR_i$. The active current regulator circuit $ACR_i$ generates a corresponding control voltage signal to regulate the current $I_{Li}$ accordingly, where i=2, . . . , N. In one embodiment the current $I_{Li}$ is regulated to be equal to the first lamp current $L_1$.

As shown in FIG. 4, a digital controller 440 is adapted for providing control voltages $\{V_{di}\}$ with each applied to the second input node $B_i$ of the corresponding active current regulator circuit $ACR_i$ for synchronizing each of the lamps $\{L_i\}$ and adjusting the brightness of each of the lamps $\{L_i\}$ dynamically, where i=2, . . . , N.

Figure 5:
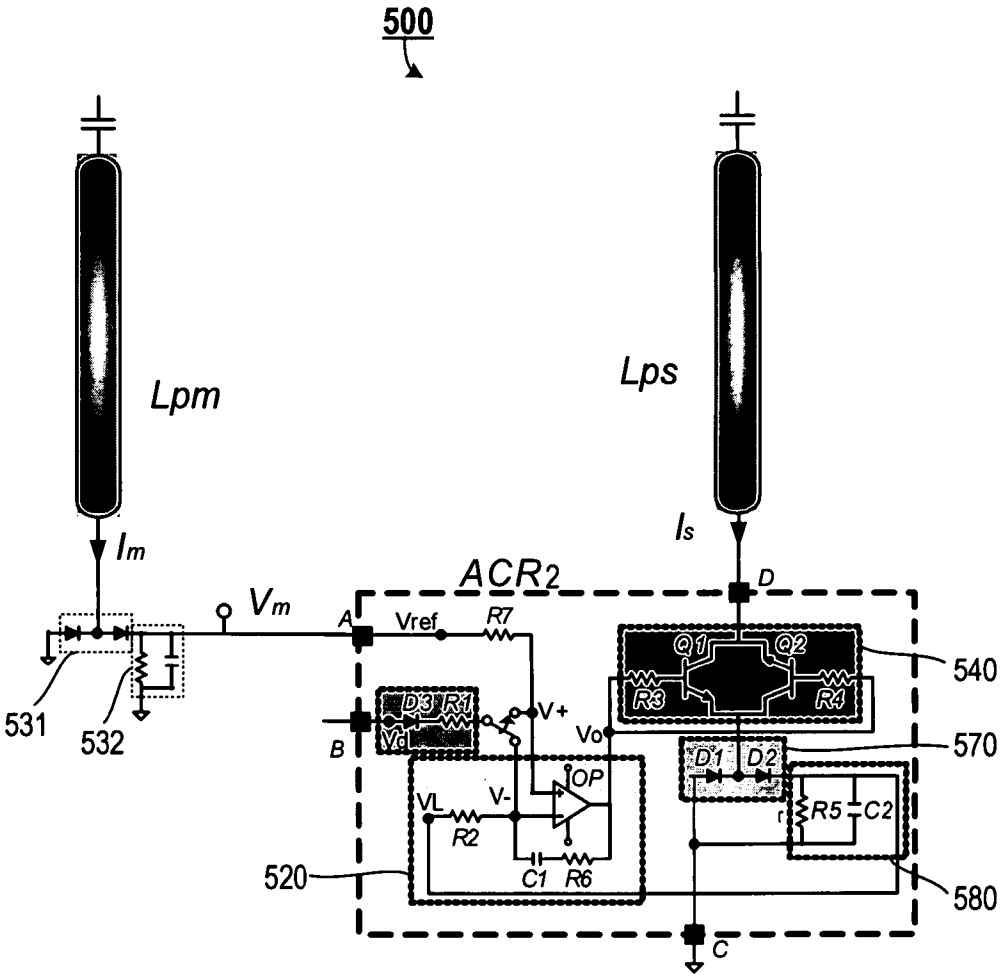
FIG. 5 shows a diagram of a light structure according to an alternative embodiment of the present invention.

FIG. 5 shows a light structure 500 having a master lamp Lpm and a slave lamp Lps, and an active current regulator circuit $ACR_2$ in communication with the master lamp Lpm and the slave lamp Lps. In operation, a lamp current $I_m$ of the master lamp Lpm is applied to a rectifier 531 and then a RC filter 532 for converting the lamp current $I_m$ into a voltage signal $V_m$. The voltage signal $V_m$ is then applied to the first input node A of the active current regulator circuit $ACR_2$, as a voltage reference signal $V_{ref}(=V_m)$ introducing into a first input node $V_+$ of a PI controller 520 of the active current regulator circuit $ACR_2$. Meanwhile, a lamp current $I_s$ of the slave lamp Lps is introduced into the node D of the active current regulator circuit $ACR_2$. The lamp current $I_s$ passes through a linear regulator 540, a rectifier 570 and then a RC filter 580 of the active current regulator circuit $ACR_2$ and is converted into a voltage signal Vs ($=V_L$). The voltage signal $V_L$ is then applied to a second input node $V_-$ of the PI controller 520 of the active current regulator circuit $ACR_2$. Accordingly, the PI controller 520 generates and outputs a corresponding voltage signal $V_0$ to drive the linear regulator 540. In the embodiment shown in FIG. 5, the linear regulator 540 functions as an effective resistor with a variable resistance that is dependent from the voltage signal $V_0$. That is, the effective impedance of the slave lamp Lps varies with the voltage signal $V_0$ in real time. Therefore, the actual lamp current of the slave lamp Lps is regulated dynamically according to the voltage signal $V_0$ that is associated with the lamp current $I_m$ of the master lamp Lps.

Figure 6:
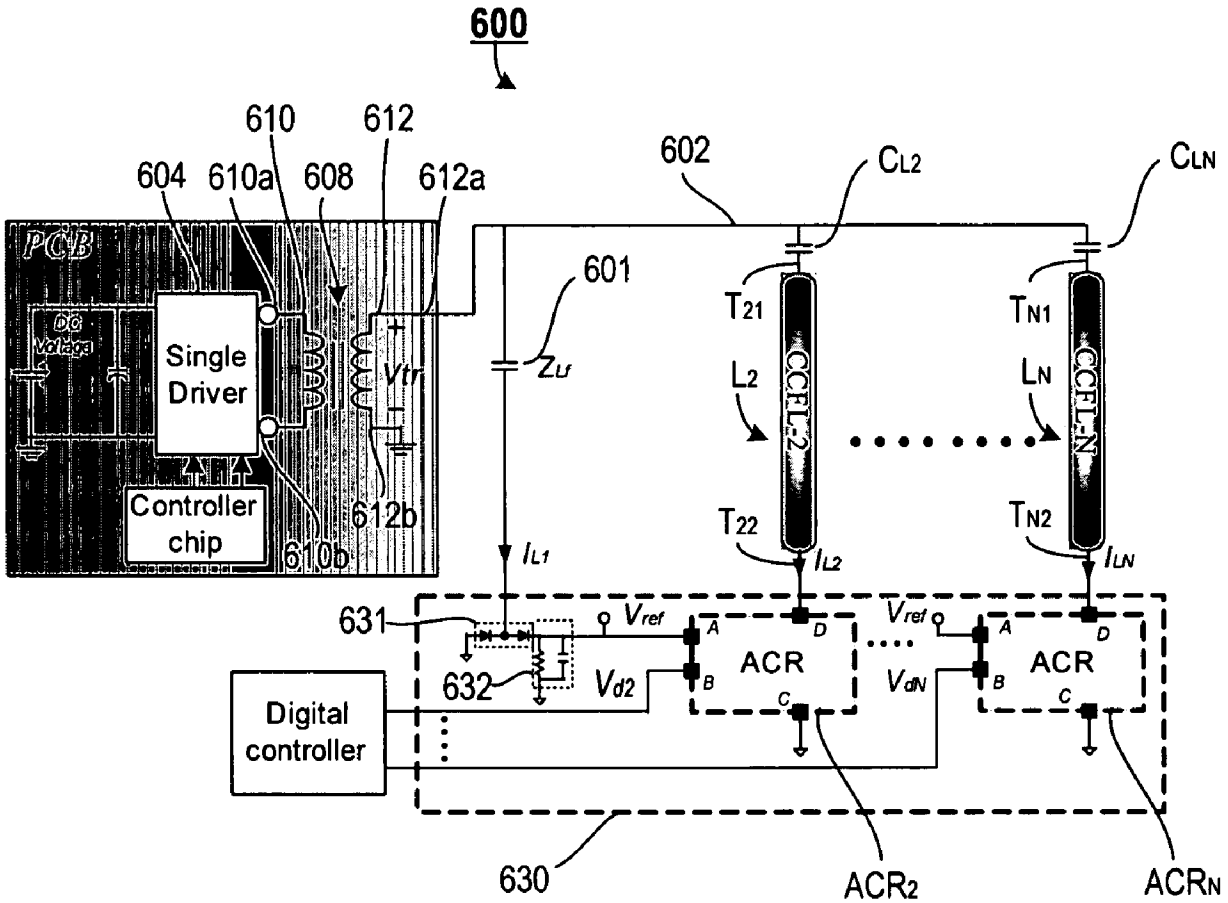
FIG. 6 shows a diagram of a light structure according to one embodiment of the present invention
Figure 7:
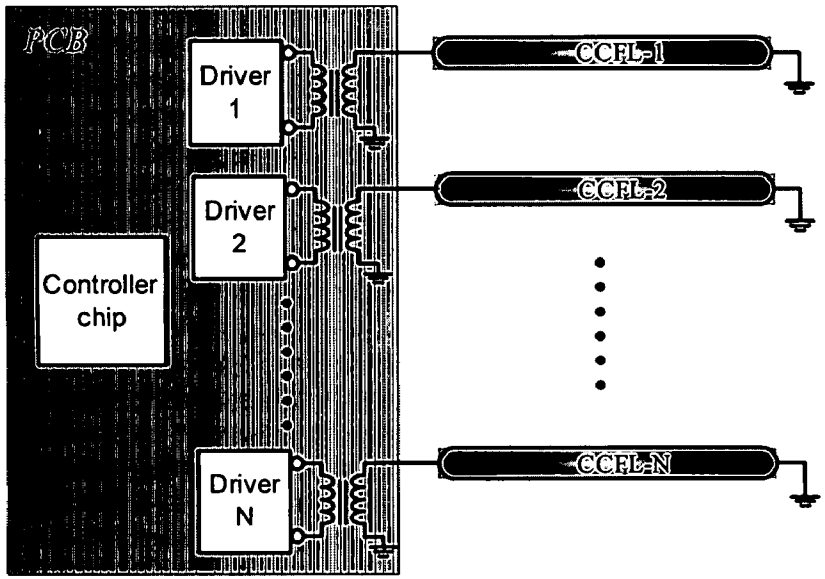
Fig. 7 (Related Art)
FIG. 7 shows a diagram of a conventional light structure.
Figure 8:
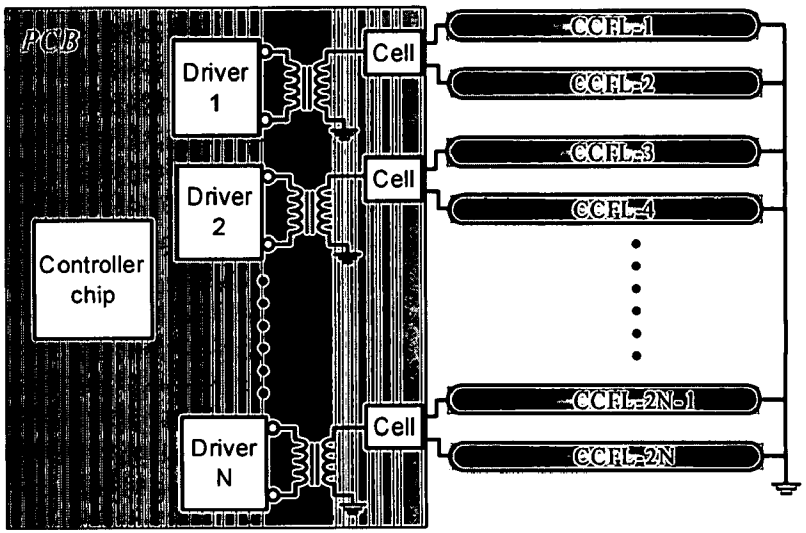
Fig. 8 (Related Art)
FIG. 8 shows a diagram of another conventional light structure.
Figure 9:
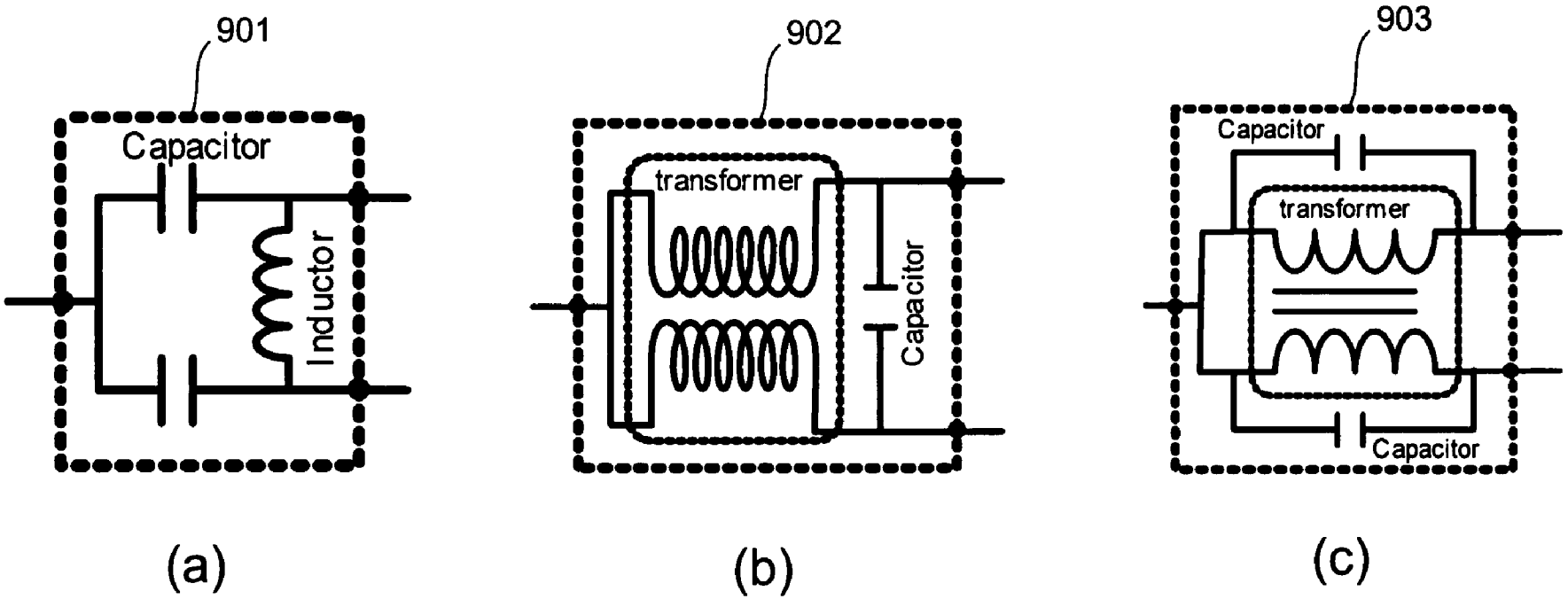
Fig. 9 (Related Art)
FIG. 9 shows diagrams of a cell of the conventional light structure shown in FIG. 8: (*a*)-(*c*) different types of the cell.
Figure 10:
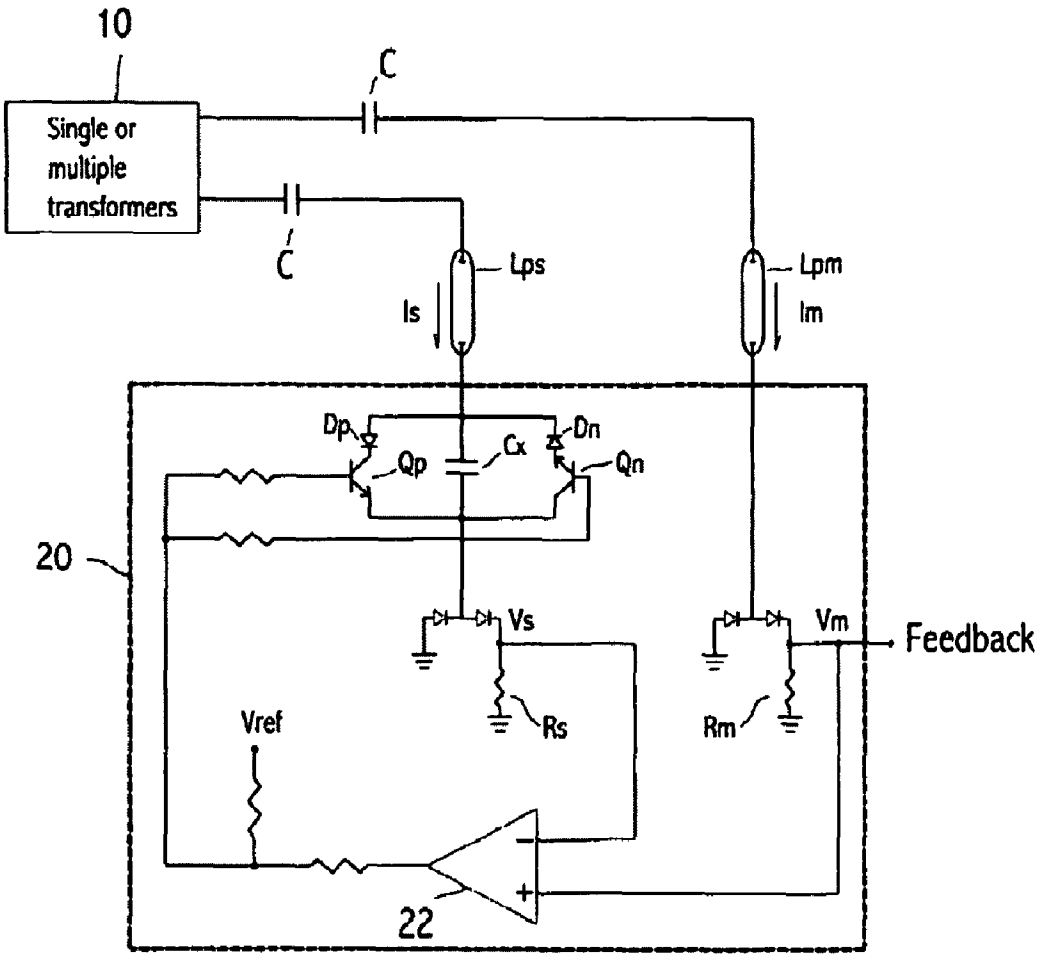
Fig. 10 (Related Art)
FIG. 10 shows a diagram of a conventional light structure.

Referring to FIG. 6, a light structure 600, in one embodiment, includes a single driver 604 electrically connectable to a DC power supply for converting a DC voltage to an AC voltage, a transformer 608 electrically coupled to the single driver 604 for providing a lamp driving voltage, an lamp module 602 electrically connected to the transformer 608, an impedance member 601 electrically coupled to the transformer 608, and a current regulator module 630 electrically coupled to the impedance member 601 and an lamp module 602.

The transformer 608 includes a primary coil 610 having a first end 610*a* and a second end 610*b* and a secondary coil 612 having a first end 612*a* and a second end 612*b*. The first end 610*a* and the second end 610*b* of the primary coil 610 are electrically coupled to the single driver 604 for receiving the AC voltage, and the second end 612*b* of the secondary coil 612 is electrically coupled to ground. Furthermore, the primary coil 610 and secondary coil 612 are electromagnetically coupled to each other and arranged such that when the AC voltage from the single driver 604 is applied to the first end 610*a* and the second end 610*b* of the primary coil 610, an output voltage is generated between the first end 612*a* and the second end 612*b* of the secondary coil 612.

The lamp module 602 has N−1 lamps, $L_2$, $L_N$, where N is an integer. Each lamp $L_i$ has a first terminal $T_{i1}$ and a second terminal $T_{i2}$, where i=2, . . . , N. The N−1 lamps are electrically coupled to the secondary coil 612 in parallel and arranged such that each first terminal $T_{i1}$ of lamp $L_i$ is electrically connected to the first end 612*a* of the secondary coil 612 for receiving the output voltage from the secondary coil 612 and a corresponding current $I_{Li}$ is generated at the corresponding second terminal $T_{i2}$ of lamp $L_i$.

The impedance member 601 is electrically coupled to the secondary coil 612 in parallel with the N−1 lamps to allow a current $I_{L1}$ to pass through, where the impedance member 601 has an effective impedance $Z_{Lf}$. The effective impedance $Z_{Lf}$ can be fixed or adjustable. The impedance member 601 can be a resistor, a capacitor, an inductor or a combination thereof.

The current regulator module 630 is electronically coupled to the N−1 lamps through the second terminals $\{T_{i2}\}$ of lamp $\{L_i\}$, i=2, . . . , N, and the impedance member 601 for dynamically regulating the currents $\{I_{Li}\}$, respectively. In the exemplary embodiment shown in FIG. 6, the current regulator module 630 comprises N−1 active current regulator circuit, $\{ACR_i\}$, i=2, . . . , N, and each active current regulator circuit $ACR_i$ is electrically connected to the second terminal $T_{i2}$ of a corresponding lamp $L_i$ for dynamically regulating current $I_{Li}$ of the corresponding lamp $L_i$ in response to a voltage reference signal $V_{ref}$ received by the active current regulator circuit $ACR_i$. In this embodiment, the voltage reference signal $V_{ref}$ is associated with the current $I_{L1}$ of the impedance member 601. As shown in FIG. 6, the current $I_{Li}$ of the impedance member 601 passes through a rectifier 631 and a RC filter 632 and is converted into the voltage signal $V_{ref}$. The voltage signal $V_{ref}$ is applied to the input node A of each active current regulator circuit $ACR_i$ as a reference signal. The active current regulator circuit $ACR_i$ generates corresponding control signals in response to the reference signal $V_{ref}$ to regulate each of the lamp current $I_{Li}$ of lamp $\{L_i\}$, i=2, . . . , N.

In one embodiment, the voltage reference signal $V_{ref}$ may be directly generated from a device, instead of a lamp or a impedance member, as shown in FIGS. 4 and 6, respectively.

Although a single driver and a single transformer are employed in the exemplary embodiments of the light structure shown in FIGS. 3, 4 and 6, two or more drivers and/or two or more transformers can also be employed to practice the current invention.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An active current regulator circuit, comprising:

a. a first input node for receiving a first reference electrical signal;

b. a second input node for receiving a second reference electrical signal;

c. a ground node;

d. an output node for outputting an output electrical signal with respect to the ground node;

e. a PI controller having a first input node, a second input node, and an output node, wherein the PI controller comprises an amplifier having a first input connected to the first input node of the PI controller, a second input connected to the second input node of the PI controller, an output connected to the output node of the PI controller, and a first capacitor with a capacitance C1 electrically coupled between the second input and the output of the amplifier;

f. a linear regulator having a first input node, a second input node, a first output node and a second output node, wherein the linear regulator comprises a first transistor with a base, an emitter and a collector, and a second transistor with a base, an emitter and a collector, wherein the emitter of the first transistor is electrically connected to the collector of the second transistor, and the collector of the first transistor is electrically connected to the emitter of the second transistor, respectively, and wherein the base of the first transistor is electrically coupled to the output of the PI controller through the first input node of the linear regulator, the base of the second transistor is electrically coupled to the output of the PI controller through the second input node of the linear regulator, the collector of the first transistor and the emitter of the second transistor are electrically connected to the first output node of the linear regulator, and the emitter of the first transistor and the collector of the second transistor are electrically connected to the second output node of the linear regulator, respectively;

g. a rectifier having a first input, a second input, and a first output, wherein the first input of the rectifier is electrically connected to the second output node of the linear regulator, the second input of the rectifier is electrically coupled to the ground node, and the first output of the rectifier is electrically coupled to the second input of the amplifier, respectively;

h. an RC filter having an input and an output, wherein the input of the RC filter is electrically connected to the first output of the rectifier, and the output of the RC filter is electrically coupled to the ground node; and i. a dimmer having an input and an output, wherein the input of the dimmer is electrically connected to the second input node, and the output of the dimmer is electrically connectable to the first input node or the second input node of the PI controller, wherein in operation, a voltage signal $V_0$, which is generated at the output node of the PI controller responsive to at least one input voltage signal applied to the first input of the second input of the amplifier, drives the linear regulator to have a controlled electrical signal at the output node accordingly.

2. The active current regulator circuit of claim 1, wherein the dimmer further comprises a diode D3 electrically coupled to the second input node through its one terminal in connection with the input of the dimmer, and a first resistor with a resistance R1 connected in series with the diode D3 and the output of the dimmer.

3. The active current regulator circuit of claim 2, wherein the PI controller further comprises a second resistor with a resistance R2 connected in series with the second input of the amplifier and the first output of the rectifier.

4. The active current regulator circuit of claim 3, wherein when the output of the dimmer is electrically connected to the second input node of the PI controller, the voltage signal $V_0$ at a given time t, $V_0(t)$, satisfies the following formula $$V_o(t) = V_{ref} + \frac{1}{R_2C_1}\int_0^{\tau}(V_{ref} - V_L)dt + \frac{1}{R_1C_1}\int_0^{\tau}(V_{ref} - V_d)dt$$

wherein $V_{ref}$ is a first input voltage signal received at the first input node of the PI controller; $V_d$ is a second input voltage signal received at the second input node of the PI controller; $V_L$ is a third input voltage signal received at the second resistor from the first output of the rectifier; and $\tau$ is the period of the first input voltage signal $V_{ref}$; and wherein the PI controller functions as an I controller.

5. The active current regulator circuit of claim 3, wherein the PI controller further comprises an optional resistor with a resistance R6 connected to the first capacitor in series and the output of the amplifier, and when the output of the dimmer is electrically connected to the second input node of the PI controller, the voltage signal $V_0$ at a given time t, $V_0(t)$, satisfies the following formula $$V_o(t) = V_{ref} + \frac{R_6}{R_2}(V_{ref} - V_L) + \frac{1}{R_2C_1}\int_0^{\tau}(V_{ref} - V_L)dt + \frac{R_6}{R_1}(V_{ref} - V_d) + \frac{1}{R_1C_1}\int_0^{\tau}(V_{ref} - V_d)dt$$

wherein $V_{ref}$ is a first input voltage signal received at the first input node of the PI controller; $V_d$ is a second input voltage signal received at the second input node of the PI controller; $V_L$ is a third input voltage signal received at the second resistor from the first output of the rectifier; and $\tau$ is the period of the first input voltage signal $V_{ref}$.

6. The active current regulator circuit of claim 5, wherein the voltage signal $V_0(t)$ outputted by the PI controller has a waveform corresponding to the waveform of the second input voltage signal $V_d$, such that the controlled electrical signal at the output node can be varied accordingly by varying the waveform of the second input voltage signal $V_d$.

7. The active current regulator circuit of claim 6, wherein the linear regulator further comprises a third resistor with a resistance R3 electrically connected to and between the first input node of the linear regulator and the base of the first transistor, and a fourth resistor with a resistance R4 electrically connected to and between the second input node of the linear regulator and the base of the second transistor.

8. The active current regulator circuit of claim 1, wherein the rectifier further comprises a first diode D1 with a positive terminal and a negative terminal, and a second diode D2 with a positive terminal and a negative terminal, wherein the positive terminal of the first diode D1 is electrically connected to the second input of the rectifier, the negative terminal of the first diode D1 and the positive terminal of the second diode D2 are electrically connected to each other and to the first input of the rectifier, and the negative terminal of the second diode D2 is electrically connected to the first output of the rectifier.

9. The active current regulator circuit of claim 1, wherein the RC filter further comprises a fifth resistor with a resistance R5 and a second capacitor with a capacitance C2, and wherein the fifth resistor and the second capacitor are electrically coupled in series to and between the input and the output of the RC filter.

10. The active current regulator circuit of claim 1, further comprising a resistor 192 with a resistance R7 electrically connected to and between the first input node of the active current regulator circuit and the first input node of the PI controller.

11. An active current regulator circuit, comprising:

a. a first input node for receiving a first reference electrical signal;

b. a second input node for receiving a second reference electrical signal;

c. a ground node;

d. an output node for outputting an output electrical signal with respect to the ground node;

e. a PI controller having a first input node, a second input node, and an output node, wherein the PI controller comprises an amplifier having a first input connected to the first input node of the PI controller, a second input connected to the second input node of the PI controller, an output connected to the output node of the PI controller, and a first capacitor with a capacitance C1 electrically coupled between the second input and the output of the amplifier; and f. a linear regulator, having a first input node, electrically coupled to the output of the PI controller, a first output node, and a second output node, and for receiving a voltage signal $V_0$ from the output of the PI controller through the first input node, of the linear regulator, wherein in operation the voltage signal $V_0$ is responsive to at least one input voltage signal applied to the first input of the second input of the amplifier and drives the linear regulator, to have a controlled electrical signal at the output node accordingly.

12. The active current regulator circuit of claim 11, further comprising a dimmer having an input and an output, wherein the input of the dimmer is electrically connected to the second input node, and the output of the dimmer is electrically connectable to the first input node or the second input node of the PI controller.

13. The active current regulator circuit of claim 12, wherein the dimmer further comprises a diode D3 electrically coupled to the second input node through its one terminal in connection with the input of the dimmer, and a first resistor with a resistance R1 connected in series with the diode D3 and the output of the dimmer.

14. The active current regulator circuit of claim 13, further comprising a rectifier having a first input, a second input, and a first output, wherein the first input of the rectifier is electrically connected to the second output node of the linear regulator, the second input of the rectifier is electrically coupled to the ground node, and the first output of the rectifier is electrically coupled to the second input of the amplifier, respectively.

15. The active current regulator circuit of claim 14, wherein the PI controller further comprises a second resistor with a resistance R2 connected in series with the second input of the amplifier and the first output of the rectifier.

16. The active current regulator circuit of claim 15, wherein when the output of the dimmer is electrically connected to the second input node of the PI controller, the voltage signal $V_0$ at a given time t, $V_0(t)$, satisfies the following formula $$V_o(t) = V_{ref} + \frac{1}{R_2C_1}\int_0^{\tau}(V_{ref} - V_L)dt + \frac{1}{R_1C_1}\int_0^{\tau}(V_{ref} - V_d)dt$$

wherein $V_{ref}$ is a first input voltage signal received at the first input node of the PI controller; $V_d$ is a second input voltage signal received at the second input node of the PI controller; $V_L$ is a third input voltage signal received at the second resistor from the first output of the rectifier; and $\tau$ is the period of the first input voltage signal $V_{ref}$; and wherein the PI controller functions as an I controller.

17. The active current regulator circuit of claim 15, wherein the PI controller further comprises an optional resistor with a resistance R6 connected to the first capacitor in series and the output of the amplifier, and when the output of the dimmer is electrically connected to the second input node of the PI controller, the voltage signal $V_0$ at a given time t, $V_0(t)$, satisfies the following formula $$V_o(t) = V_{ref} + \frac{R_6}{R_2}(V_{ref} - V_L) + \frac{1}{R_2C_1}\int_0^{\tau}(V_{ref} - V_L)dt +$$

-continued $$\frac{R_6}{R_1}(V_{ref} - V_d) + \frac{1}{R_1C_1}\int_0^{\tau}(V_{ref} - V_d)dt$$

wherein $V_{ref}$ is a first input voltage signal received at the first input node of the PI controller; $V_d$ is a second input voltage signal received at the second input node of the PI controller; $V_L$ is a third input voltage signal received at the second resistor from the first output of the rectifier; and $\tau$ is the period of the first input voltage signal $V_{ref}$.

18. The active current regulator circuit of claim 17, wherein the voltage signal $V_0(t)$ outputted by the PI controller has a waveform corresponding to the waveform of the second input voltage signal $V_d$, such that the controlled electrical signal at the output node can be varied accordingly by varying the waveform of the second input voltage signal $V_d$.

19. The active current regulator circuit of claim 15, wherein the linear regulator comprises a first transistor with a base, an emitter and a collector, and a second transistor with a base, an emitter and a collector, wherein the emitter of the first transistor is electrically connected to the collector of the second transistor, and the collector of the first transistor is electrically connected to the emitter of the second transistor, respectively, and wherein the base of the first transistor is electrically coupled to the output of the PI controller through the first input node of the linear regulator, the base of the second transistor is electrically coupled to the output of the PI controller through the second input node of the linear regulator, the collector of the first transistor and the emitter of the second transistor are electrically connected to the first output node of the linear regulator, and the emitter of the first transistor and the collector of the second transistor are electrically connected to the second output node of the linear regulator, respectively.

20. The active current regulator circuit of claim 19, wherein the linear regulator further comprises a third resistor 155 with a resistance R3 electrically connected to and between the first input node of the linear regulator and the base of the first transistor, and a fourth resistor with a resistance R4 electrically connected to and between the second input node of the linear regulator and the base of the second transistor.

21. The active current regulator circuit of claim 15, wherein the linear regulator comprises a transistor with a base, an emitter and a collector, and an impedance electrically connected to and between the collector and the emitter of the transistor, and wherein the base of the transistor is electrically coupled to the output of the PI controller through the first input node of the linear regulator, the collector of the transistor is electrically connected to the first output node of the linear regulator, and the emitter of the transistor is electrically connected to the second output node of the linear regulator, respectively.

22. The active current regulator circuit of claim 21, wherein the impedance comprises one of a resistor, a capacitor and an inductor.

23. The active current regulator circuit of claim 15, wherein the rectifier further comprises a first diode D1 with a positive terminal and a negative terminal, and a second diode D2 with a positive terminal and a negative terminal, wherein the positive terminal of the first diode D1 is electrically connected to the second input of the rectifier, the negative terminal of the first diode D1 and the positive terminal of the second diode D2 are electrically connected to each other and to the first input of the rectifier, and the negative terminal of the second diode D2 is electrically connected to the first output of the rectifier.

24. The active current regulator circuit of claim 15, further comprising an RC filter having an input and an output, wherein the input of the RC filter is electrically connected to the first output of the rectifier, and the output of the RC filter is electrically coupled to the ground node.

25. The active current regulator circuit of claim 24, wherein the RC filter further comprises a fifth resistor with a resistance R5 and a second capacitor with a capacitance C2, and wherein the fifth resistor and the second capacitor are electrically coupled in parallel to and between the input and the output of the RC filter.

26. The active current regulator circuit of claim 11, further comprising a resistor with a resistance R7 electrically connected to and between the first input node of the active current regulator circuit and the first input node of the PI controller.

* * * * *